United States Patent [19]

Toki et al.

[11] Patent Number: 4,501,234

[45] Date of Patent: Feb. 26, 1985

[54] BLOW-BY GAS PASSAGE SYSTEM FOR INTERNAL COMBUSTION ENGINES

[75] Inventors: Susumu Toki; Kenichi Nagahiro, both of Saitama, Japan

[73] Assignee: Honda Giken Kogyo Kabushiki Kaisha, Tokyo, Japan

[21] Appl. No.: 549,983

[22] Filed: Nov. 8, 1983

[30] Foreign Application Priority Data

Nov. 15, 1982 [JP] Japan ..... 57-172480[U]

[51] Int. Cl.[3] ..... F02F 9/02

[52] U.S. Cl. ..... 123/41.86; 123/196 R; 123/572; 123/573

[58] Field of Search ..... 123/572, 573, 574, 196 R, 123/41.86, 90.38; 55/419

[56] References Cited

U.S. PATENT DOCUMENTS 3,754,538 8/1973 Ephraim, Jr. et al. ..... 123/41.86
3,769,798 11/1973 Whittaker ..... 123/572
4,404,936 9/1983 Tatebe et al. ..... 123/196 R

FOREIGN PATENT DOCUMENTS 112056 12/1940 Australia ..... 123/574
375975 10/1939 Italy ..... 123/573
46-1208 1/1971 Japan ..... 123/574
125307 9/1980 Japan ..... 123/574

*Primary Examiner*—E. Rollins Cross
*Attorney, Agent, or Firm*—Lyon & Lyon

[57] ABSTRACT

Blow-by gas passages are formed on one side of the cylinder block and cylinder head of an internal combustion engine and spaced longitudinally of its crankshaft. The passages extend from the interior of the crankcase to a location above an upper face of the cylinder head, one of the passages being provided with a mounting port for an oil separator. The other blow-by passage is also connected to the separator, and the separator is connected to the intake system of the engine.

5 Claims, 7 Drawing Figures

BLOW-BY GAS PASSAGE SYSTEM FOR INTERNAL COMBUSTION ENGINES

The present invention relates to a blow-by gas passage system for an internal combustion engine and, more particularly, to such a blow-by gas passage system in which a series of improved blow-by gas passages are formed in the cylinder block and the cylinder head.

An air-fuel mixture having been drawn into the combustion chamber of an internal combustion engine is ignited and is burned until it is discharged to the atmosphere outside of the engine. Generally speaking, not all of the air-fuel mixture is completely burned and discharged, but a portion of the unburned mixture during the compression stroke and a portion of the burned gas during the explosion stroke leak through the clearance space between the piston and the cylinder wall into the crankcase. This leak gas will be called the "blow-by gas" in the following.

This blow-by gas has to be discharged to the atmosphere outside of the engine partly because it deteriorates the quality of lubricating oil in the crankcase, and partly because the leak pressure tends to increase the pressure in the crankcase. Such unwanted pressure increase may cause leaking of the lubricating oil and the back flow of the lubricating oil into the cylinder head overlying the engine. Generally speaking, therefore, a passage system (which is called the "blow-by gas passage") is required for removing the blow-by gas from within the crankcase and for returning it into the combustion chamber, from the standpoint of reduction of air pollution.

In the prior art, a first blow-by gas passage having one end opened in the crankcase and its other end communicating with an oil separator is disposed in a predetermined position at one side of the cylinder block. The blow-by gas flows from the crankcase side opening into the first-named blow-by gas passage. The blow-by gas thus guided is introduced into the oil separator, where the lubricating oil is separated out. The blow-by gas is then conveyed into an intake manifold so that it is returned into the combustion chamber together with the incoming air-fuel mixture. In the side portions of the cylinder block and the cylinder head, moreover, there is disposed a second blow-by gas passage which has one end opened in the crankcase and its other end communicating with the upper face of the cylinder head fixed on the cylinder block. This second blow-by gas passage is also used as a return passage for lubricating oil remaining on the upper face of the cylinder head into the oil pan.

The aforementioned other end of the second blow-by gas passage is made to communicate with the combustion chamber through a breather chamber, an air cleaner, a carburetor and the said inlet manifold. In this way the blow-by gas in the crankcase is drawn during a low load running operation of the engine into the oil separator through said first passage by the action of a relatively high vacuum prevailing in the inlet manifold. Since a vacuum is established in the crankcase at this time, fresh air is introduced from the air cleaner by way of said second passage. During a high load running operation of the engine, on the other hand, the flow rate of air to be drawn through the air cleaner into the inlet manifold is increased so that the blow-by gas accordingly flows back through said second passage and breather chamber until it is introduced into the air cleaner.

In the blow-by gas passages thus far described, however, especially in the high load running operation of the engine, the second passage is commonly used as the return hole of the lubricating oil from the valve actuating mechanism, which is arranged in the cylinder head, so that the lubricating oil may be blown up to enter into the intake system. This would have the advantage that oil mist wets and damages the air cleaner element.

Since the aforementioned blow-by gas passage must total a certain cross-sectional area, moreover, the cylinder block and the cylinder head would require a larger space than available, with the disadvantage that they would interfere with other accessories to enlarge the overall size of the engine.

The present device has been conceived in view of the points thus far described and has an object to improve the blow-by gas passage system of an internal combustion engine. In order to achieve this object, there is provided a blow-by gas passage system for an internal combustion engine, which system is disposed in the side portions of the cylinder block and the cylinder head fixed thereto. The system has one end opened to face the inside of a crankcase forming the lower portion of said cylinder block and its other end opened in the upper face of said cylinder head. The system is characterized in that it includes two or more blow-by passages formed in one-side portions of said cylinder block and said cylinder head; and in that either of said passages is formed with a mounting port for an oil separator, whereby the face pressure of the blow-by gas passage system at the mating faces of the cylinder block and cylinder head is raised. The cross-sectional area of one passage is reduced while maintaining the necessary cross-sectional area of the blow-by gas system, to improve the sealability and to solve the problem concerning the spacing of the side faces of the cylinder block and the cylinder head. Accordingly, during the low load running operation of the engine the other blow-by gas passages not having the oil separator is supplied only with fresh air to promote clarification of the inside of the crankcase, whereas during the high load running operation of the engine the lubricating oil is prevented from being blown up out of the crankcase.

Figure 1:
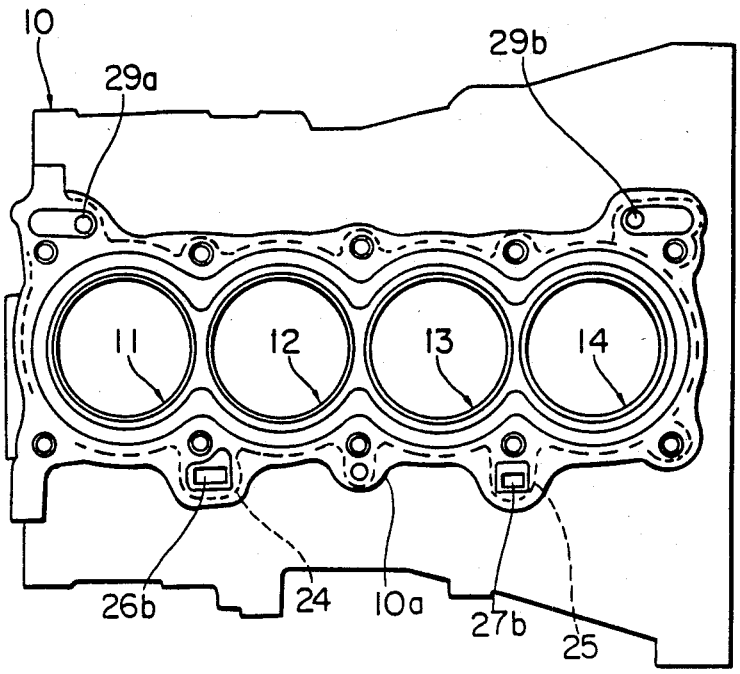
FIG. 1 is a plan view of an engine cylinder head comprising a preferred embodiment of this invention.
Figure 3:
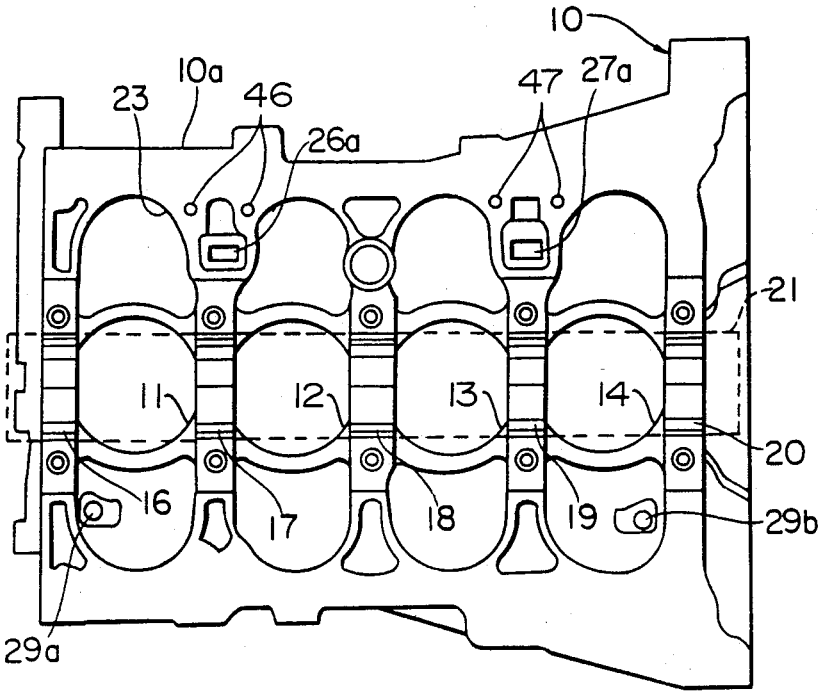
FIG. 3 is a bottom plan view.
Figure 4:
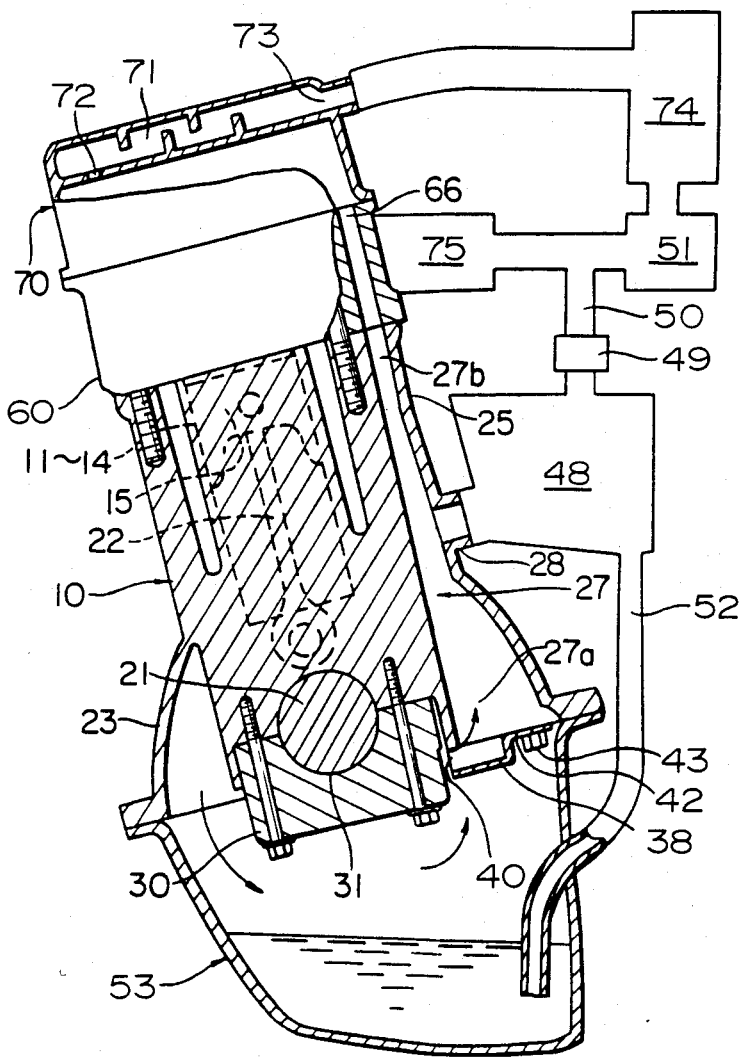
FIG. 4 is an end elevation partly in section and partly in diagrammatic form.

Referring to the drawings, as shown in FIG. 1, cylinders 11, 12, 13 and 14 are longitudinally juxtaposed in a cylinder block 10 which has generally rectangular upper face. In each of the cylinders 11 to 14, as shown in FIGS. 3 and 4, there is fitted a piston 15 which is connected through a connecting rod 22, as indicated by broken lines in FIG. 4, to a crankshaft 21. The crankshaft 21 is borne by crankshaft bearing portions 16, 17, 18, 19 and 20 of the cylinder block 10 and the crankshaft bearing portions 31 of bearing caps 30.

The cylinder block 10 has its one side portion 10*a* formed with passages 26 and 27 which are located in two vertical boss portions 24 and 25 positioned at one side of the crankshaft bearing portions 17 and 19 and bulging outwardly of the cylinder block 10. Those passages 26 and 27 have certain end portions 26*a* and 27*a* expanded and opened in one side of the bearing portions 17 and 19 at the lower faces of the boss portions 24 and 25. The passages 26 and 27 have certain other portions 26*b* and 27*b* opened in the upper face of the cylinder block 10. The effective cross-sectional areas of those two passages 26 and 27 are made about one-half of that of the aforementioned single blow-by gas passage according to the prior art. For example, the sum of those two passages 26 and 27 is set substantially equal to that of the single passage of the prior art. Because of this reduction in the effective areas of the passages 26 and 27, the face pressure of these passages at the mating faces 32 between the cylinder block 10 and the cylinder head 60 is raised. This improves the sealability of those mating faces, and the bulging extent of the boss portions 24 and 25 can be reduced to reduce the overall width of the cylinder block 10 and the cylinder head 60. Moreover, the necessary effective area of the blow-by gas passage system is maintained by the sum of the effective areas of the two passages 26 and 27. Moreover, the lower end portions 26*a* and 27*a* of the passages 26 and 27 extending through the portions of the crankshaft bearing portions 17 and 19 are expanded, as shown in FIG. 4, in those certain parts of the bearing portions 17 and 19 to reduce the thicknesses of the bearing portions 17 and 19.

Figure 5:
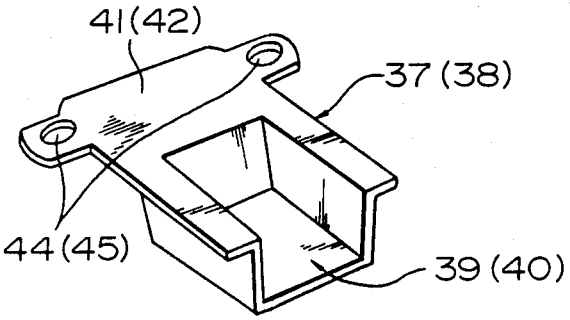
FIG. 5 is a perspective detail showing one of the cover parts used for restricting entry of lubricating oil into a passage for removing blow-by gases from the engine crankcase.

The crankshaft bearing portions 16 to 20 are not severely splashed with the droplets of the lubricant which is contained within the crankcase by the rotations of the crankshaft 21, and the bearing portions 17 and 19 are less loaded by the rotations of the crankshaft 21 than the bearing portion 18. The boss portions 24 and 25 containing the passages 26 and 27 are equipped on their lower faces with covers 37 and 38 for restricting entry of lubricant splash into the passages 26*a* and 27*a*. These covers 37 and 38 are formed, as shown in FIG. 5, into generally box shapes having their sides 39 and 40 open. Their upper faces 41 and 42 are fixedly fastened to the lower faces of those boss portions 24 and 25 by means of threaded fastenings 43 which are screwed through bolt holes 44 and 45 and into threaded holes 46 and 47 (as shown in FIG. 3) formed in the lower faces of the boss portions 24 and 25.

Figure 2:
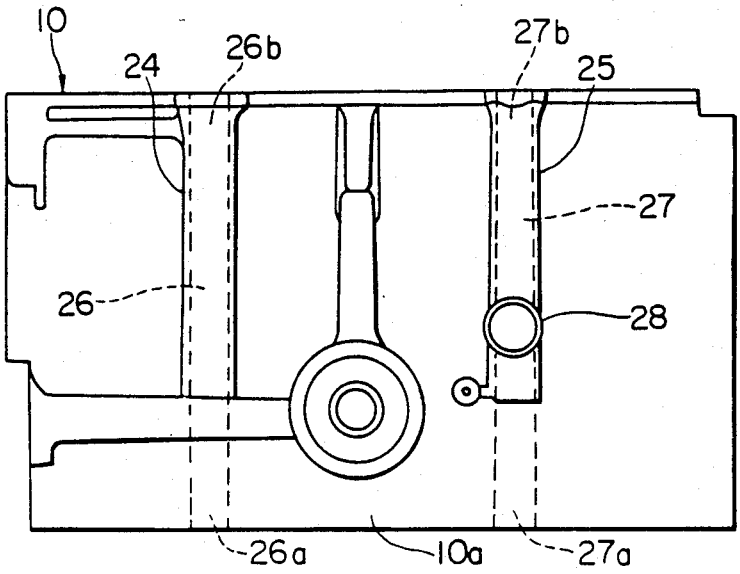
FIG. 2 is a side elevation.

The boss 25 is formed at its substantially central portion, as shown in FIGS. 2 and 4, with a cylindrical oil separator mounting port 28 which has its one end communicating with the passage 27 and its other end communicating with the suction port of an oil separator 48. To this oil separator 48 there are connected through a PCV valve 49 both a pipe 50 communicating with the downstream of a carburetor 51 and a pipe 52 communicating with the oil pan 53. Thus, by shortening the passage from the crankcase 23 to the oil separator 48 and by making it possible to attach the oil separator 48 directly to the side of the engine, the space especially for the PCV system in the engine room can be reduced.

Figure 6:
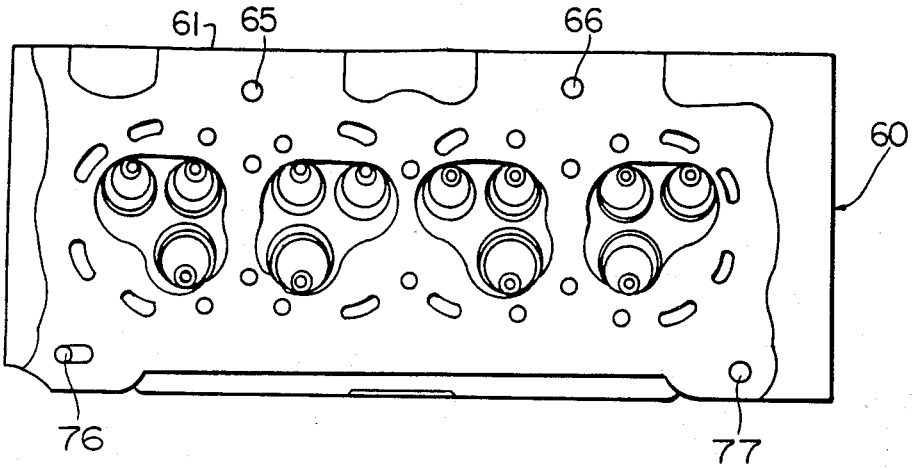
FIG. 6 is a bottom plan view of a modified form of cylinder head.
Figure 7:
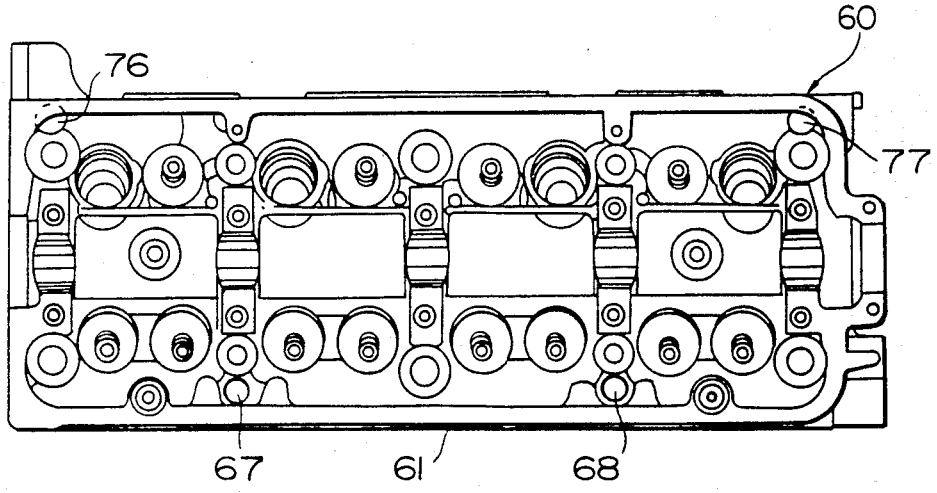
FIG. 7 is a plan view of the head shown in FIG. 6.

As shown in the modification of FIGS. 6 and 7, the cylinder head 60 is fixedly placed on the upper portion of the cylinder block. That cylinder head 60 has its one side portion 61 formed with passages which have their lower end portions 65 and 66 communicating with the upper end portions of the aforementioned passages 26 and 27 of the cylinder block 10 and their upper end portions 67 and 68 opened in the upper face of the cylinder head 60.

The cylinder head 60 is crowned with a cylinder head cover 70, as shown in FIG. 4. This cylinder head cover 70 is formed in its upper portion with a breather chamber 71 having the shown shape, which has its one-side opening 72 opened in the cylinder head cover 70 and its otherside opening 73 communicating with an air cleaner 74. This air cleaner 74 is made to communicate with the carburetor 51 and an inlet manifold 75 which is secured to the side portion of the cylinder head 60.

The cylinder block 10 and the other side portion of the cylinder head 60 are formed with a series of passage 29*a*, 29*b*, 76 and 77 exclusively for returning the lubricant, which passages have their one-side ends opened in the crankcase 23 and their other-side ends opened in the upper face of the cylinder head 60.

During the high load operation of the engine, the blow-by gas leaking into the crankcase 23 is drawn into the two passages 26 and 27 of the cylinder block 10, respectively, through the openings 39 and 40 of the lubricant splash restricting covers 37 and 38. Since the openings 26*a* and 27*a* of the passages 26 and 27 are opened in the vicinity of the bearings 17 and 19 which tend to be splashed with the lubricant by the rotations of the crankshaft, and since the lubricant splash restricting covers 37 and 38 provide blocking walls, the lubricant splash into the passages 26 and 27 is restricted. Because the passages 26 and 27, 65 and 66 are formed separately of the passages 29*a*, 29*b*, 76 and 77 that are especially provided for returning the lubricating oil, the lubrication of the value actuating mechanism disposed in the upper portion of the cylinder head 60 is achieved. Accordingly, very little of the lubricating oil is carried by the blow-by gas into the air cleaner 74.

During the low road running operation of the engine, the blow-by gas is drawn from the crankcase by the vacuum in the inlet manifold through the passage 27, and the oil separator mounting port 28 into the oil separator 48 in which the lubricating oil contained in the blow-by gas is removed. The blow-by gas is introduced through the PCV valve 49, the pipe 50 and the inlet manifold 75 into the combustion chamber, not shown. The lubricant having been separated in the oil separator 48 from the blow-by gas is returned through the pipe 52 to the oil pan 53. In the series passages constructed of the aforementioned passages 26 and 65, breather chamber 71 and air cleaner 74, during such low load running operation the cleaned ambient air is sucked through the air cleaner 74 and further through the breather chamber 71, the inside of the cylinder head cover 70 and the passages 65 and 26 into the crankcase 23. In this way clean air flows into the crankcase 23. In addition, some clean air may be drawn in through passages 66 and 27 to port 28 and the oil separator 48 under the low load running condition.

Having fully described our invention, it is to be understood that we are not to be limited to the details herein set forth but that our invention is of the full scope of the appended claims.

What is claimed:

1. For use with a multi-cylinder internal combustion engine having a crankshaft, crankcase, a cylinder block and a cylinder head with overhead valves and a breather, the improvement comprising, in combination:

blow-by gas passages formed on one side of the cylinder block and cylinder head, said blow-by gas passages communicating with the interior of the crankcase and extending above an upper face of the cylinder head in communication with the breather, one of said blow-by passages being provided with a mounting port, an oil separator carried on said mounting port, means connecting only said one blow-by passage to said separator, and means connecting the separator and breather to the intake system of the engine.

2. For use with a multi-cylinder internal combustion engine having a crankshaft, crankcase, a cylinder block and a cylinder head, the improvement comprising, in combination: two blow-by gas passages formed on one side of the cylinder block and cylinder head and spaced longitudinally of the crankshaft, said blow-by passages each communicating with the interior of the crankcase and extending above an upper face of the cylinder head, a first of said blow-by passages being provided with a mounting port, a baffle at the lower end of said first blow-by passage to restrict entry of gases and splash oil from the crankcase, an oil separator carried on said mounting port, means connecting said first blow-by passage to said separator, and means connecting the separator to the intake system of the engine.

3. A blow-by gas recovery system for a multi-cylinder internal combustion engine having a crankcase, a cylinder block, an intake system, an oil separator, and a cylinder head with overhead valves and a breather, the improvement comprising, blow-by gas passage means formed in the cylinder block and cylinder head for communicating the interior of the crankcase with the interior of the cylinder head, said blow-by gas passage means opening into said cylinder head at a location to inhibit the entry of lubricating oil in the cylinder head, oil drain passage means formed in the cylinder block and cylinder head for communicating the interior of the cylinder head with the interior of the crankcase, said oil drain passage means opening into the cylinder head at a location for promoting the drain of all the lubricating oil from the cylinder head, said blow-by gas passage means including at least one passage extending between the crankcase and cylinder head and having means connected to the oil separator, and means connecting the oil separator and breather to the intake system of the engine.

4. The blow-by gas recovery system of claim 3 wherein the blow-by gas passage means are located on one side of the cylinder block and cylinder head, and the oil drain passage means is located on the other side of the cylinder block and cylinder head.

5. The blow-by gas recovery system of claim 4 wherein the cylinder block is tilted at an angle to the vertical and the said oil drain passage means are located on the lower side of the cylinder block and open into the lower side of the cylinder head.

* * * * *

UNITED STATES PATENT AND TRADEMARK OFFICE

CERTIFICATE OF CORRECTION

PATENT NO. : 4,501,234

DATED : February 26, 1985

INVENTOR(S) : Susumu Toki and Kenichi Nagahiro

It is certified that error appears in the above—identified patent and that said Letters Patent is hereby corrected as shown below:

Column 2, line 9, change "advantage" to --disadvantage--.

Column 2, line 63, after "has" insert --a--.
Column 4, line 35, change "value" to --valve--.

Signed and Sealed this

*Twenty-eighth* Day of *January 1986*

[SEAL]

*Attest:*

DONALD J. QUIGG

*Attesting Officer*

*Commissioner of Patents and Trademarks*